United States Patent [19]

Mailloux

[11] 4,013,355

[45] Mar. 22, 1977

[54] NOTCH FILTER FOR COLOR TRANSPARENCY COPYING MACHINES

[75] Inventor: Louis D. Mailloux, Arcadia, Calif.

[73] Assignee: Xerox Corporation, Stamford, Conn.

[22] Filed: July 30, 1975

[21] Appl. No.: 600,345

[52] U.S. Cl. ..... 355/4; 96/1.2; 355/32; 355/71; 355/79

[51] Int. Cl.[2] ..... G03G 15/01

[58] Field of Search ..... 96/1.2; 355/4, 3 R, 355/32, 33, 35, 44, 45, 71, 79

[56] References Cited

UNITED STATES PATENTS

| | | | |
|---|---|---|---|
| 3,248,216 | 4/1966 | Weigl | 355/3 R |
| 3,517,596 | 6/1970 | Johnson et al. | 355/32 |
| 3,547,533 | 12/1970 | Stokes et al. | 355/3 R |
| 3,561,866 | 2/1971 | Cohen | 355/44 |
| 3,642,370 | 2/1972 | Meredith et al. | 355/79 |
| 3,936,173 | 2/1976 | Kidd et al. | 96/1.2 |

*Primary Examiner*—L. T. Hix
*Assistant Examiner*—J. A. LaBarre
*Attorney, Agent, or Firm*—J. J. Ralabate; C. A. Green; H. Fleischer

[57] ABSTRACT

An electrophotographic printing machine in which color transparencies are reproduced. The printing machine includes a notch filter which transmits blue and green light images of the color transparency therethrough while blocking a portion of the red light image from passing therethrough.

12 Claims, 5 Drawing Figures

NOTCH FILTER FOR COLOR TRANSPARENCY COPYING MACHINES

BACKGROUND OF THE INVENTION

This invention relates generally to an electrophotographic printing machine, and more particularly concerns a color electrophotographic printing machine for reproducing color transparencies.

In the process of electrophotographic printing, a photoconductive member is charged and exposed to a light image of an original document. The light image irradiates the charged portion of the photoconductive surface selectively discharging the charge thereon. In this manner, an electrostatic latent image is recorded on the photoconductive surface corresponding to the informational areas at the original document. A development system positions a developer mix of carrier granules and toner particles in contact with the electrostatic latent image. The toner particles are attracted electrostatically from the carrier granules to the latent image forming a toner powder image on the photoconductive surface. Thereafter, the toner powder image is transferred from the photoconductive surface to a sheet of support material. After the toner powder image has been transferred to the sheet of support material, a fuser permanently affixes the toner powder image thereto.

Numerous types of machines have been developed to mechanize the reproduction of microfilm. U.S. Pat. No. 3,424,525 issued to Towers et al. in 1969; U.S. Pat. No. 3,542,468 issued to Blow, Jr. in 1970; and U.S. Pat. No. 3,547,533 issued to Stokes et al. in 1970 all describe machines which produce an enlarged hard copy from a microfilm input.

With the advent of color electrophotographic printing, it became highly desirable to reproduce color transparencies or microfilm as pictorial quality opaque or hard copies. Multicolor electrophotographic printing is essentially the same as the process heretofore described. However, in multicolor electrographich printing, each cycle is for a discrete color contained within the original document. Hence, successive light images are filtered recording different color electrostatic latent images on the photoconductive surface. Each electrostatic latent image corresponds to a single color contained within the original document. The single color electrostatic latent images are developed with toner particles of a color complementary to the color of the filtered light image. These toner particles are transferred from the latent image to a sheet of support material in superimposed registration with one another. The multi-layered toner powder image on the sheet of support material is subsequently permanently affixed thereto forming a color copy of the original document.

As previously indicated, it is highly desirable to have the capability of reproducing color transparencies or microfilm. This may be achieved by projecting a light image of the color transparency through a screen disposed on the machine platen. The modulated light image is filtered as it passes through the machine optics to selectively discharge the charged portion of the photoconductive surface. Successive single color electrostatic latent images are formed and developed. These powder images are transferred to the sheet of support material, in superimposed registration with one another, resulting in the copy corresponding to the light image of the color transparency being projected through the machine optics. A Fresnel lens and screen a-c is positioned on the platen. The Fresnel lens converges the diverging light rays of the light image, while the screen modulates the light image. Machines of the foregoing type are more fully described in copending application Ser. No. 540,617 filed Jan. 13, 1975.

It has been found that, in general, a color electrophotographic printing machine does not produce satisfactory color copies when used in conjunction with a slide projector containing a tungsten lamp. The problem lies in the red separation and is attributable to the relatively broad red separation filter employed in the electrophotographic printing machine. For example, the 50% transmittance point of the red fiter may be at 575 namometers. The energy between 575 namometers and 610 namometers causes color containing magnets to be excessively dark. This produces a copy having excessive cyan in colors containing magenta. However, it is desirable to employ such a filter in order to satisfactorily reproduce colored opaque originals. Thus, there are two conflicting objectives, i. e. reproduction of opaque copies which require a broad red separation filter, and the reproduction of color transparencies which require a narrower red separation filter.

Accordingly, it is a primary object of the present invention to improve the copy quality of color transparencies being reproduced in an electrophotographic printing machine without degrading the quality of opaque copies being reproduced.

BRIEF SUMMARY OF THE INVENTION

Briefly stated, and in accordance with the present invention, there is provided an electrophotographic printing machine for reproducing color transparencies.

In the present instance, the printing machine includes a photoconductive member which is charged to a substantially uniform level. Successive light images of the color transparency are formed and modulated producing successive half-tone light images thereof. Means are provided to filter each light image forming successive blue, red, and green light images thereof. A notch filter is interposed into the optical path to block a portion of the red light image while transmitting the blue and green light images therethrough. Each modulated, filtered light image, transmitted through the notch filter, irradiates the charged portion of the photoconductive member recording thereon successive single color electrostatic latent images.

BRIEF DESCRIPTION OF THE DRAWINGS

Other objects and advantages of the present invention will become apparent upon reading the following detailed description and upon reference to the drawings, in which.

Figure 1:
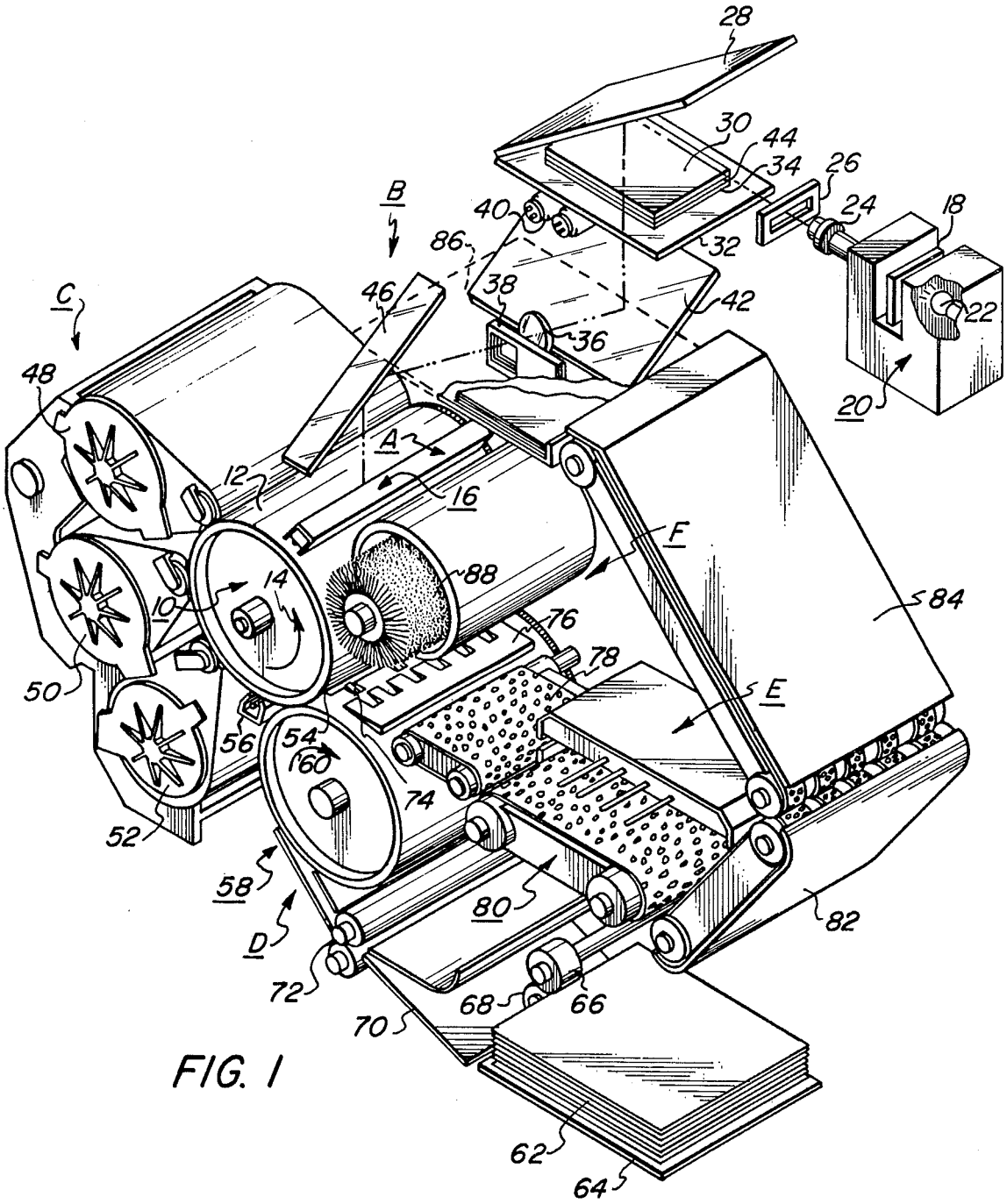
FIG. 1 is a schematic perspective view of an electrophotographic printing machine incorporating the features of the present invention therein.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

For a general understanding of a color electrophotographic printing machine incorporating the features of the present invention therein, continued reference is had to the drawings. In the drawings, like reference numerals have been used throughout to designate like elements. Although the color electrophotographic printing machine of the present invention is particularly well adapted for producing color copies from color transparencies or microfilm, it should become evident from the following discussion that it is equally well suited for use in a wide variety of applications such as producing color copies from opaque originals, as well as black and white copies from balck and white transparencies or from black and white opaque originals, and is not necessarily limited to the particular embodiment shown herein.

As illustrated in FIG. 1, the electrophotographic printing machine employes a photoconductive member having a drum 10 mounted rotatably within the machine frame (not shown) with photoconductive surface 12 secured thereto and entrained thereabout. Preferably, photoconductive surface 12 is made from a suitable panchromatic selenium alloy such as is described in U.S. Pat. No. 3,655,377 issued to Sechak in 1972.

As drum 10 rotates in the direction of arrow 14, photoconductive surface 12 passes through a series of processing stations located about the periphery thereof. Drum 10 is driven at a constant speed so that the proper sequencing of events may be established at each processing station. Timing for each event is achieved by a disc (not shown) mounted in the region of one end of the shaft of drum 10. This disc has a plurality of slits in the periphery thereof. A light source is mounted on one side of the disc with a photosensor being mounted on the other side thereof. As the slits in the disc transmit the light rays from the light source to the photosensor, the photosensor generates electrical pulses. The pulses from the photosensor processed by the machine logic to synchronize the various operations at the respective processing stations with the rotation of drum 10.

Initially, drum 10 rotates through charging station A. At charging station A, corona generating device, indicated generally by the reference numeral 16, sprays ions onto photoconductive surface 12 producing a relatively high, substantially uniform charge thereon. A suitable corona generating device is described in U.S. Pat. No. 3,875,407 issued to Hayne in 1975, the relevant portions thereof being hereby incorporated into the present application.

After photoconductive surface 12 is charged to a substantially uniform potential drum 10 rotates the charged portion thereof to exposure station B. At exposure station B, a color filtered light image of color transparency 18, as exemplified by a 35mm. slide, is projected onto the charged portion of photoconductive surface 12. Color transparency 18 is positioned in slide projector 20. Slide projector 20 includes a light source 22 adpated to illuminate transparency 18. In addition, slide projector 20 comprises a lens 24 having an adjustable focus to produce an enlarged or magnified image of color transparency 18. Finally, a notch filter 26 is interposed into the optical light path and mounted on a suitable bracket secured to slide projector 20. Notch filter 26 blocks a portion of the red light image while transmitting the blue and green light images therethrough. The detailed characteristics of the notch filter will be discussed hereinafter with reference to FIG. 5. An enlarged image of color transparency 18 passes through notch filter 26 and is directed onto mirror 28. Mirror 28 reflects the enlarged image in a downward direction through Fresnel lens 30. Interposed between Fresnel lens 30 and transparent platen 32 is an optional opaque sheet 34 having an aperture therein, i.e. a picture frame or informational frame, which may be considered a composition frame. Composition frame 34 defines an opaque border extending outwardly from the color transparency image formed on platen 32. Frame 34 may have indicia inscribed thereon. The scanning system includes a moving lens system designated generally by the reference numeral 36, and a color filter mechanism shown generally at 38. Lamps 40 move in a timed relationship with lens 36 and filter mechanism 38 to scan and illuminate successive incremental areas of composition frame 34 which may be optionally placed on platen 32.

A screen 44 may be disposed beneath Fresnel lens 30, i.e. interposed between Fresnel lens 30 and composition frame 34. Screen 44 modulates the color transparency image forming a halftone light image which is combined with the image of composition frame 34 forming a combined image. In this manner, a combined image of the enlarged color transparency image and composition frame is formed.

Size for size copies of the transparency rather than enlarged copies thereof may be optionally formed. In this mode, projector 20 serves as an additional illumination source. Transparency 18 is placed on platen 22 with composition frame 34 still positioned over portion of platen 32. The aperture in frame 34 is designed to extend in an outward direction from the borders of transparency 18. Moreover, a plurality of transparencies may be positioned on platen 32 with composition frame 34 having a plurality of apertures therein adapted to be positioned over each transparency. Hence, the copy being reproduced by the electrophotographic printing machine will comprise one or a plurality of size for size transparencies.

As shown is FIG. 1, screen 44 is interposed between frame 34 and Fresnel lens 30. A light image is projected through notch filter 26 and reflected in a downwardly direction by mirror 28 to pass through screen 44 so as to be modulated thereby. The combined light image of the transparency and composition frame is reflected by mirror 42 through lens 36 and filter 38 forming a single color light image. The single color light image is reflected by mirror 46 in a downward direction onto the charged portion of photoconductive surface 12. Thus, the modulated single color light image irradiates the charged portion of photoconductive surface 12 recording a single color electrostatic latent image thereon. Similarly, the light image of composition frame 34 irradiates the charged portion of photoconductive surface 12 forming an unmodulated light image thereof in registration with the single color electrostatic latent image formed from the modulated light image of the color transparency.

Filter mechanism 38 interposes selected color filters into the optical path of lens 36 during the exposure process. The appropriate filter operates on the light rays transmitted through lens 36 to form a light image corresponding to a single color of the transparency.

As heretofore indicated, lamps 40 are arranged to traverse platen 32 illuminating incremental widths of composition frame 34. Lamps 40 are mounted on a suitable carriage (not shown) which is driven by a cable pulley system (not shown) from the drive motor (not shown) rotating drum 10. As the lamp carriage traverses platen 32, another cable pulley system (not shown) moves lens 36 and filter 38 at a correlated speed therewith. Filter assembly 38 is mounted on a suitable bracket extending from lens 36 to move in conjunction therewith. Lamps 40, lens 36, and filter 38 scan the combined image formed on platen 32 to produce a flowing light image thereof. Slide projector 20 projects an enlarged image of color transparency 18 onto mirror 28. Preferably, projector 20 is a Kodak Carousel 750-H Projector having an F/2.8 Ektanar C projection lens with light source 22 being a tungsten lamp. Tungsten lamp 22 illuminates color transparency 18 with lens 24 being arranged to produce an enlarged image of the color transparency 18. The light image of the color transparency passes through notch filter 26 which blocks a portion of the red while transmitting all of the blue and green therethrough.

Preferably, Fresnel lens 30 comprises small, recurring, light deflecting elements that will, as an entire unit, achieve a uniform distribution of light over a predetermined area. The gratings or grooves therein are preferably about 200 or more per inch. Fresnel lens 30 converges the diverging light rays from lens 30 passing through notch filter 26. Thus, the light rays transmitted through platen 32 are substantially parallel. Other suitable field lenses may be employed in lieu of the Fresnel lens. The light image of the color transparency passes through a screen which modulates it forming a halftone light image. Hence, a modulated light image is combined with the image of composition frame 34 and incremental areas thereof are projected onto photoconductive surface 12 discharging the charge thereon. Light rays are reflected from mirror 42 through lens 36 and filter 38 forming a single color light image which is reflected by mirror 46 onto the charged portion of photoconductive surface 12. Upon reaching the end of the path of scan, lamps 40, lens 36 and filter 38 are spring biased to return to their original position for the start of the next successive cycle. It should be clear that the movement of lens 36, filter 38 and lamps 40 are correlated with the speed of rotation of drum 10 for exposure of the charged portion of photoconductive surface 12. For further details regarding the drive mechanism of the optical system, reference is had to U.S. Pat. No. 3,062,108 issued to Mayo et al. in 1962.

Preferably, lens 36 is a six-element split dagor type of lens having front and back compound lens components with a centrally located diaphragm therebetween. Lens 36 forms a high quality image with a field angle of about 31° and a speed ranging from about F/4.5 to about F/8.5 at a 1:1 magnification. In addition, lens 36 is designed to minimize the effect of secondary color in the image plane. The front lens component has three lens elements including, in the following order, a first lens element of positive power, a second lens element of negative power cemented to the first lens element, and a third lens element of positive power disposed between the second lens element and the diaphragm. The back lens component also has three similar lens elements positioned so that lens 36 is symmetrical. Specifically, the first lens element in the front component is a double convex lens, the second element a double concave lens, and the third element a convex-concave lens element. For greater details regarding lens 36, reference is made to U.S. Pat. No. 3,592,531 issued to McCrobie in 1971, the relevant portions of that disclosure being hereby incorporated into the present application.

With continued reference to FIG. 1, filter 38 includes a housing which is mounted on lens 36 by a suitable bracket and moves with lens 36 during scanning as a single unit. The housing of filter 38 includes a window which is positioned relative to lens 36 permitting the light rays of the combined image. i.e., that of the composition frame and transparency to pass therethrough. Bottom and top walls of the housing include a plurality of tracks which extend the entire width thereof. Each track is adpated to carry a filter so as to permit movement thereof from an inoperative position to an operative position. In the operative position, the filter is interposed into the window of the housing permitting light rays to pass therethrough. Individual filters are made from any suitable filter materials such as coated glass. Preferably, three filters are employed in the electrophotographic printing machine, a red filter, a blue filter and a green filter. The spectral characteristics of each of the foregoing filters will be discussed hereinafter in greater detail with reference to FIGS. 2 through 4, inclusive. A detailed description of the filter mechanism is found under U.S. Pat. No. 3,775,006 issued to Hartman et al. in 1973, the relevant portions of that disclosure being hereby incorporated into the present application.

Preferably, screen member 44 includes a substantially transparent sheet made from a suitable plastic or glass. A plurality of spaced, opaque dots or lines are printed on the transparent sheet by a suitable chemical etching or photographic technique. The screen may be made from any number of opaque metallic materials suitable for chemical etching which are sufficiently thin to be flexible, such as copper or aluminum. The spacing between adjacent lines or dots determines the quality of the resulting copy. A fine screen size generally results in a more natural or higher quality copy. Hence, while a coarse screen having 50 to 60 lines or dots per inch will be useful for some purposes, finer screens such as those having anywhere from 100 to 400 dots or lines per inch will form a copy of nearly continuous tone appearance. With finer screens, the screen pattern may be barely perceptible on the finished copy and the copy will have the appearance of a continuous tone photograph. Preferably, a dot screen is positioned on the platen. A suitable line screen will have about 120 lines per inch. Contrawise, a suitable dot screen may include a plurality of equally spaced soft gray square dots having 85 dots per inch. However, this may range from about 65 to 300 dots per inch. The foregoing is only limited by the optical system and the desired resolution. A suitable dot screen for disposition on the platen is manufactured by the Caprock Corporation and may be a negative screen. An optical system employing such a screen for reproducing transparencies is described in copending application Ser. No. 540,617 filed in 1975.

With continued reference to FIG. 1, after the electrostatic latent image is recorded on photoconductive surface 12, drum 10 rotates to development station C. At development station C, three individual developer units, generally indicated by the reference numerals 48, 50, and 52, respectively are arranged to render visible the electrostatic latent image recorded on photoconductive surface 12. Preferably, each of the developer units are of a type generally referred to in the art as "magnetic brush developer units". A typical magnetic brush developer unit employs a magnetizable developer mix which includes carrier granules and heat settable toner particles. In operation, the developer mix is continually brought through a directional flux field forming a chain-like array of fibers extending outwardly from a developer roll. This chain-like array of fibers is frequently termed a brush. The electrostatic latent image recorded on photoconductive surface 12, is rotated into contact with the brush of developer mix. Toner particles are attracted from the carrier granules to the latent image. Each of the developer units contain appropriately colored toner particles. For example, a green filtered light image is developed by depositing magenta toner particles thereon. Similarly, a red filtered light image is developed with cyan toner particles and a blue filtered light image with yellow toner particles. This type of development process is termed substractive. A development system of this type is described in U.S. Pat. No. 3,854,449 issued to Davidson in 1974.

After the single color electrostatic latent image is developed, drum 10 rotates to transfer station D. At transfer station D, the toner powder image adhering electrostatically to photoconductive surface 12 is transferred to a sheet of support material 54. Support material 54 may be plain paper or a sheet of thermoplastic material, amongst others. Transfer station D includes corona generating means, indicated generally at 56, and a transfer roll designated generally by the reference numeral 58. Corona generator 56 is excited with an alternating current and arranged to pre-condition the toner powder image adhering electrostatically to photoconductive surface 12. In this manner, the preconditioned toner powder image will be more readily transferred from the electrostatic latent image recorded on photoconductive surface 12 to support material 54 secured releasably on transfer roll 58. Transfer roll 58 recirculates support material 54 and is electrically biased to a potential of sufficient magnitude and polarity to attract electrostatically the pre-conditioned toner particles from the latent image recorded on photoconductive surface 12 to support material 54. Transfer roll 58 rotates in the direction of arrow 60, in synchronism with drum 10, to maintain support material 54 secured releasably thereon in registration with the electrostatic latent image recorded on photoconductive surface 12. This enables successive toner powder images to be transferred to support material 54 in superimposed registration with one another. U.S. Pat. No. 3,838,918 issued to Fisher in 1974 discloses a suitable transfer system.

Prior to proceeding with the remaining processing stations, the sheet feeding apparatus will be briefly described. Support material 54 is advanced from a stack 62 mounted on a tray 64. Feed roll 66, in operative communication with retard roll 68, advances and separates the uppermost sheet from stack 62. The advancing sheet moves into chute 70 which directs it into the nip between register rolls 72. Register rolls 72 align and forward the sheet to gripper fingers 74 which secure support material 54 releasably on transfer roll 58. After the requisite number of toner powder images have been transferred to support material 54, gripper fingers 74 release support material 54 and space it from transfer roll 58. As transfer roll 58 continues to rotate in the direction of arrow 60, stripper bar 76 is interposed therebetween. In this way, support material 54 passes over stripper bar 76 onto endless belt conveyor 78. Endless belt conveyor 78 advances support material 54 to fixing station E.

At fixing station E, a fuser, indicated generally by the reference numeral 80, generates sufficient heat to permanently affix the multi-layered powder images to support material 54. A suitable fusing device is described in U.S. Pat. No. 3,781,516 issued to Tsilibes et al. in 1973.

After the fixing process, support material 54 is advanced by endless belt conveyors 82 and 84 to catch tray 86 permitting the machine operator to remove the finished color copy from the printing machine.

Although a preponderance of the toner particles are transferred to support material 54, invariably some residual toner particles remain on photoconductive surface 12 after the transfer of the toner powder image therefrom. The residual toner particles are removed from photoconductive surface 12 at cleaning station F. Cleaning station F includes a cleaning corona generating device (not shown) which neutralizes the electrostatic charge remaining on the residual toner particles and photoconductive surface 12. The neutralized toner particles are then cleaned from photoconductive surface 12 by a rotatably mounted fibrous brush 88 in contact therewith. A suitable brush cleaning device is described in U.S. Pat. No. 3,590,412 issued to Gerbasi in 1971.

It is believed that the foregoing description is sufficient for purposes of the present application to depict the general operation of the color electrophotographic printing machine incorporating the features of the present invention therein.

Figure 2:
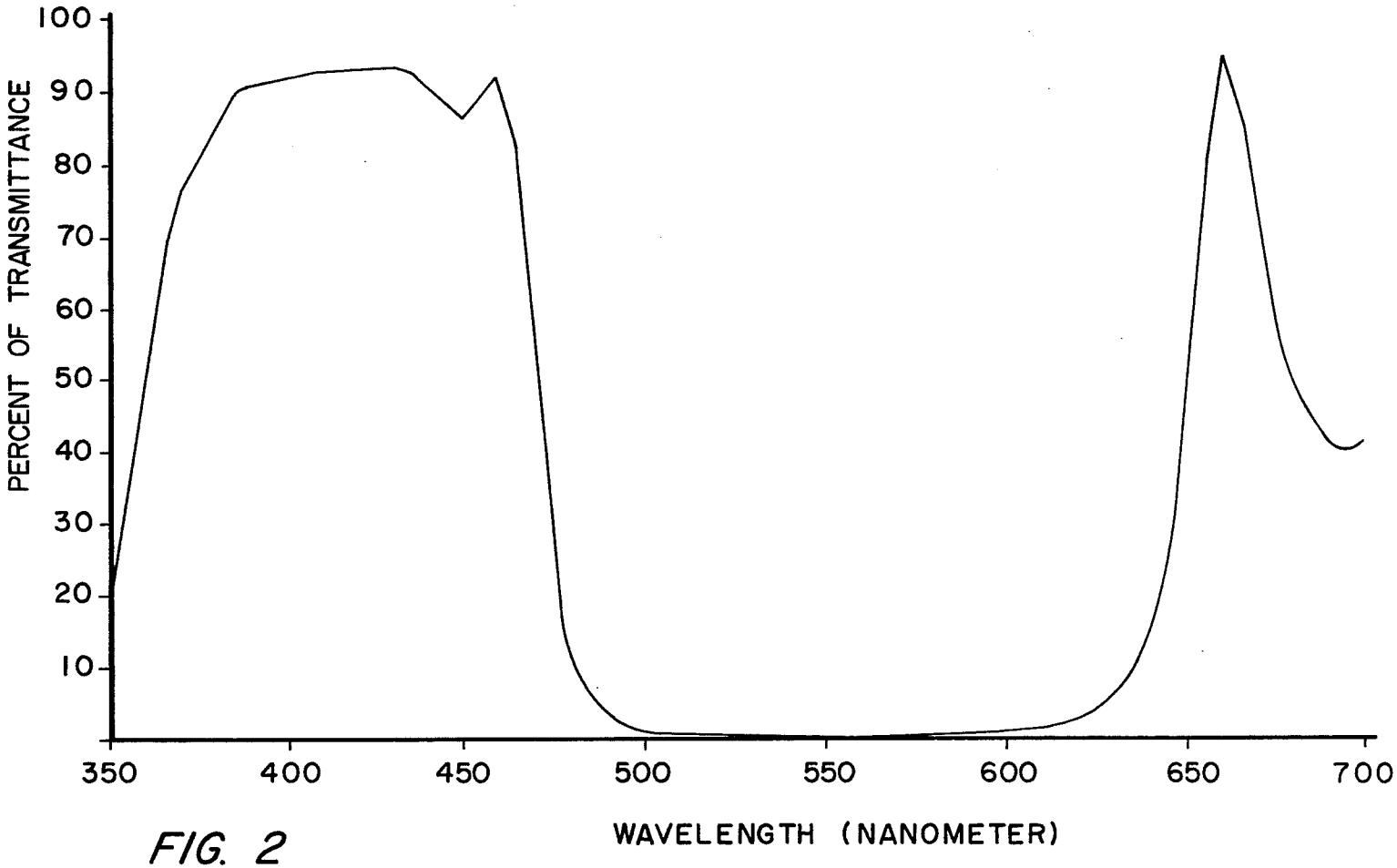
FIG. 2 is a graph illustrating the spectral characteristics of the blue filter employed in the FIG. 1 printing machine.

Referring now to FIG. 2, the spectral characteristics of the blue filter employed in the FIG. 1 printing machine will be discussed. As shown in FIG. 2, the transmittance increases from about 20% at about 350 nanometers to about 90% at about 385 nanometers. The transmittance remains substantially at about 90% from about 385 nanometers to about 460 nanometers. Thereafter, the transmittance decreases from about 90% at about 460 nanometers to about 10% at about 480 nanometers. It should be noted that the transmittance of the blue filter remains greater than about 70% from about 375 nanometers to about 470 nanometers. The transmittance of the blue filter remains less than 10% from about 480 nanometers to about 630 nanometers. At 630 nanometers, the transmittance increases and reaches a transmittance of about 90% at about 660 nanometers. Thereafter, the transmittance decreases to about 40% at about 700 nanometers. Preferably, the blue filter is made from a suitably coated glass having the spectral characteristics illustrated in FIG. 2.

Referring now to FIG. 2, the spectral characteristics of the red filter employed in the FIG. 1 printing machine are shown thereat. The transmittance of the red filter remains less than 10% from about 350 nanometers to about 560 nanometers. Thereafter, the transmittance increases to about 90B at about 610 nanometers. The transmittance of the red filter is greater than 70% from about 580 nanometers to about 700 nanometers. By way of example, a red filter having the spectral characteristics may be made from a suitable coated glass.

Figure 4:
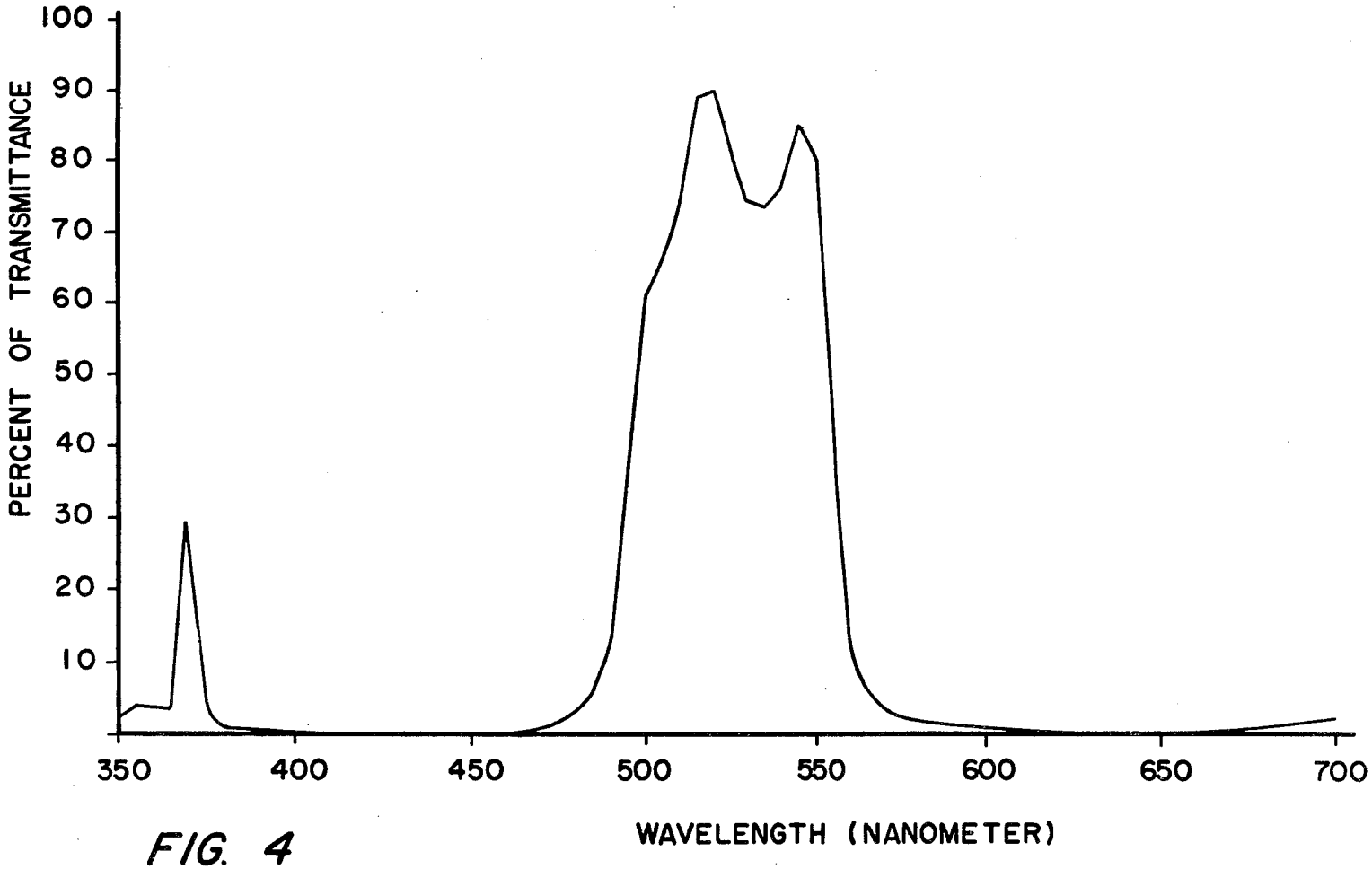
FIG. 4 is a graph depicting the spectral characteristics of the green filter used in the FIG. 1 printing machine.

Turning now to FIG. 4, the characteristics of the green filter are illustrated therein. The transmittance of the green filter increases from less than 10% at 350 nanometers to about 30% at about 370 nanometers. Thereafter, the transmittance decreases to less than 10% at about 375 nanometers and remains less than 10% until about 470 nanometers. At 470 nanometers, the transmittance increases to greater than 70% at about 510 nanometers. The transmittance remains greater than 70% until about 550 nanometers. At about 550 nanometers, the transmittance decreases to less than 10% at about 570 nanometers and remaining at that level to about 700 nanometers. Once again, a suitable green filter having the spectral characteristics illustrated in FIG. 4 may be made from a coated glass.

Figure 5:
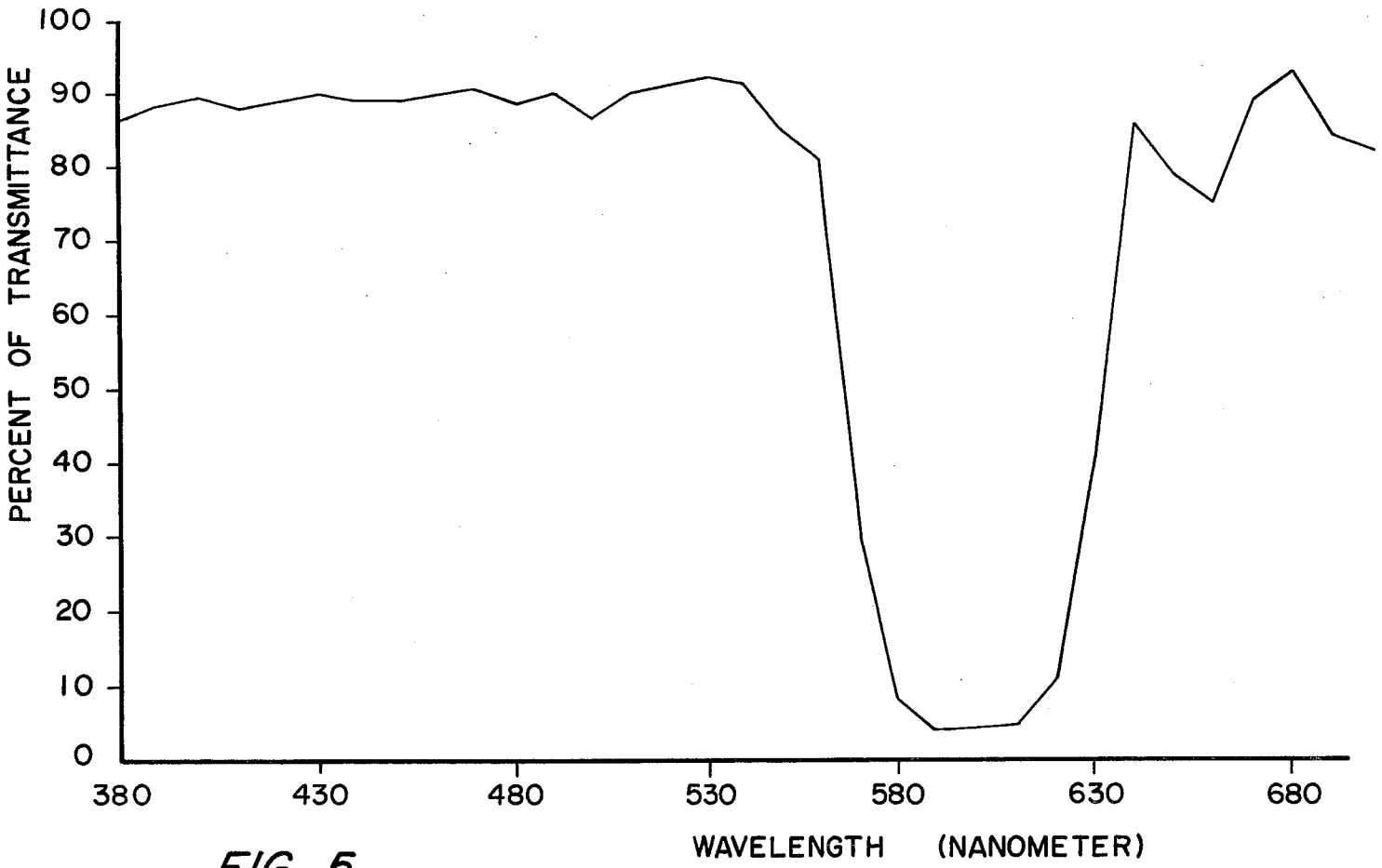
FIG. 5 is a graph illustrating the spectral characteristics of the notch filter used in the FIG. 1 printing machine.

Referring now to FIG. 5, the spectral characteristics of notch filter 26 are depicted therein. As shown in FIG. 5, the transmittance of notch filter 26 remains greater than 70% from about 380 nanometers to about 560 nanometers. At about 560 nanometers the transmittance decreases from 70% to less than 10% at about 580 nanometers. The transmittance remains less than 10% from about 580 nanometers to about 620 nanometers. At about 620 nanometers the transmittance increases reaching 70% at about 635 nanometers and remaining greater than 70% until about 700 nanometers. A suitable notch filter having the spectral characteristics shown in FIG. 5 may be formed from a coated glass.

Figure 3:
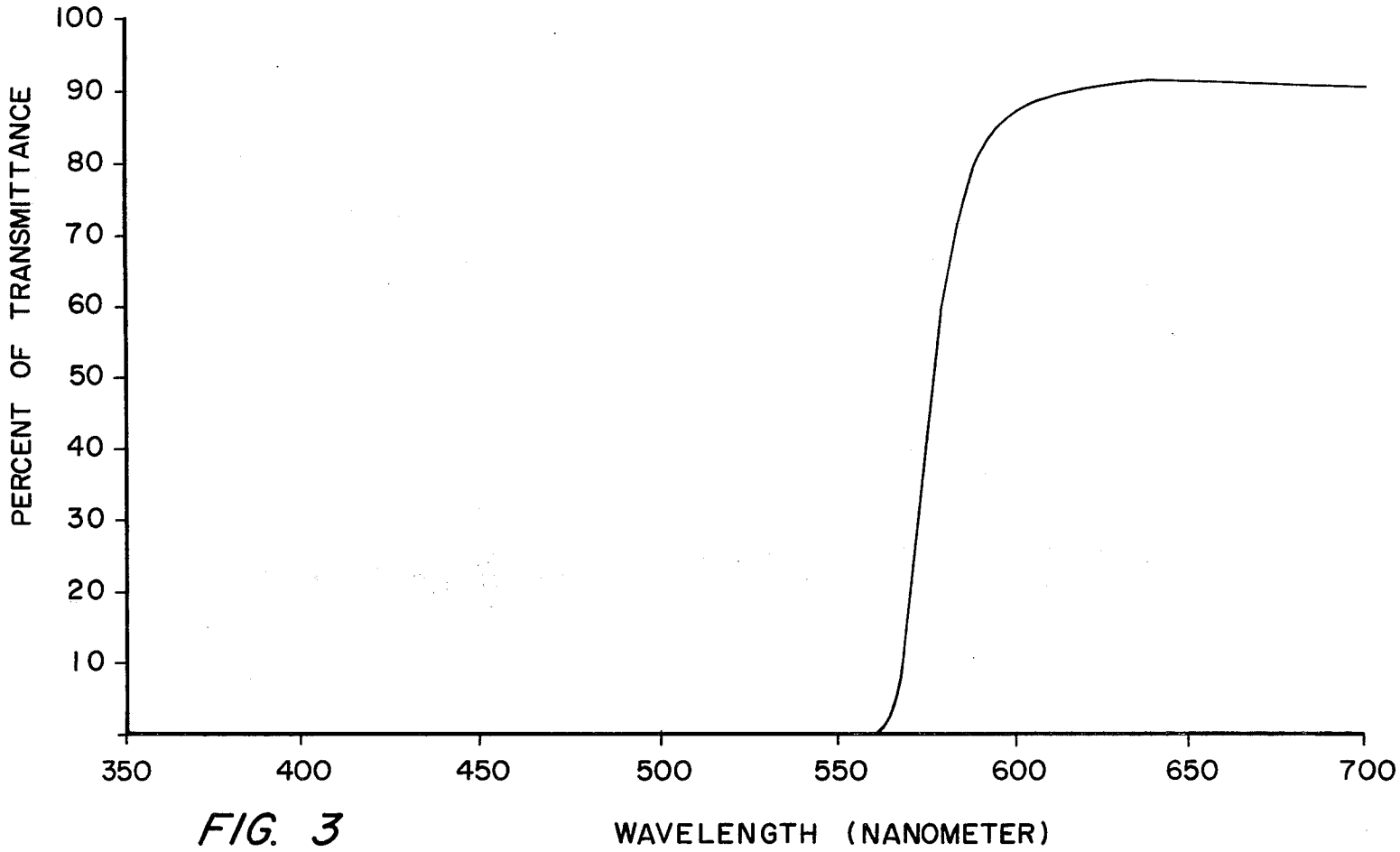
FIG. 3 is a graph showing the spectral characteristics of the red filter used in the FIG. 1 printing machine.

Combining the graph of FIG. 5 with the graphs of FIGS. 2 through 4, inclusive, one skilled in the art will appreciate that the notch filter has no effect on the characteristics of the blue filter depicted in FIG. 2. This is due to the fact that the blue filter has a transmittance of less than 10% from about 480 to about 630 nanometers and the notch filter has a transmittance of less than 10% from about 580 nanometers to about 620 nanometers, thereby producing no further attenuation of the light rays passing through the blue filter. Similarly, the green filter as shown in FIG. 4, has a transmittance of less than 10% from about 570 nanometers to about 700 nanometers. Once again, the notch filter has a transmittance of less than 10% from about 580 nanometers to about 620 nanometers and the combination of notch filter 26 with the green filter produces no further attenuation of the light rays transmitted therethrough. Contrawise, the combination of the red filter and the notch filter produces further attenuation of the light rays. As shown in FIG. 3, the red filter has a transmittance of less than 10% from about 350 nanometers to about 560 nanometers. Thereafter, the transmittance increases from about 10% to about 70% at about 570 nanometers. The notch filter has a transmittance of less than 10% from about 580 nanometers to about 620 nanometers. Therefore, light rays passing through both the red filter and the notch filter will have a transmittance of less than 10% from about 350 nanometers to about 620 nanometers. Thus, the notch filter reduces the transmittance of the light rays passing through the red filter in the region of from about 580 nanometers to about 620 nanometers to less than 10%. This reduces the transmittance between 575 nanometers and 610 nanometers resulting in a copy which no longer has excessive cyan in colors containing magenta.

In recapitulation, the electrophotographic printing machine depiced in FIG. 1 is adpated to produce a color opaque copy from a color transparency. The transparency may be copied size for size or enlarged. In addition, a composition frame with or without indicia thereon may be combined therewith. The color transparency may be a conventional 35 MM slide or any other type of microfilm. The foregoing is achieved by projecting an image of the color transparency through a Fresnel lens, a composition frame, and a screen. A combined image of the color transparency and composition frame is filtered and projected onto the photoconductive surface recording a modulated single color electrostatic latent image thereon. Each differently colored single color electrostatic latent image is developed with toner particles complementary in color to the color of the filtered light image. Significant improvement in the images reproduced is achieved by the utilization of a notch filter in the optical path adpated to block a portion of the red light image, while permitting all of the blue and light images to pass therethrough.

Thus, it is apparent that there has been provided, in accordance with the present invention, an electrophotographic printing machine that fully satisfies the objects, aims and advantages set forth above. While this invention has been disclosed in conjunction with a specific embodiment thereof, it is evident that many alternatives modifications and variations will be apparent to those skilled in the art in light of the foregoing description. Accordingly, it is intended to embrace all such alternatives, modifications and variations that fall within the spirit and broad scope of the appended claims.

What is claimed is:

1. An electrophotographic printing machine for reproducing a color transparency, including:

a photoconductive member;

means for producing a charge having a substantially uniform level on at least a portion of said photoconductive member;

means for forming a light image of the color transparency;

means for modulating the light image to produce a halftone light image;

means for filtering successive light images of the color transparency to form successive blue, red, and green light images thereof; and a notch filter interposed into the optical path to block a portion of the red light image while transmitting the blue and green light images therethrough, each light image transmitted through said notch filter passing through said filtering means and said modulating means to irradiate the charged portion of said photoconductive member recording thereon successive single color electrostatic latent images.

2. A printing machine as recited in claim 1, further including:

a supporting member;

an opaque document positioned on said supporting member; and means for exposing the charged portion of said photoconductive member to a light image of said opaque document recording thereon a combined electrostatic latent image of the single color electrostatic latent image of the color transparency and the electrostatic latent image of said opaque document.

3. A printing machine as recited in claim 2, wherein said forming means projects a light image of the color transparency through said supporting member.

4. A printing machine as recited in claim 3, wherein said opaque document includes a composition frame defining an opaque border extending outwardly from the color transparency image transmitted through said supporting member.

5. A printing machine as recited in claim 3, wherein said forming means includes a slide projector located on the printing machine for projecting an image of the color transparency disposed therein through said supporting member.

6. A printing machine as recited in claim 5, wherein said supporting member includes:

a transparent platen having said opaque document disposed thereon; and a Fresnel lens mounted on said opaque document.

7. A printing machine as recited in claim 6, wherein said modulating means inlcudes a screen interposed between said Fresnel lens and said opaque document.

8. A printing machine as recited in claim 7, wherein said screen includes a transparent sheet having a plurality of opaque, spaced dots thereon.

9. A printing machine as recited in claim 2, wherein said exposing means includes:

a light source arranged to illuminate said opaque document positioned on said supporting member; and lens means for receiving the light rays from the combined image of the color transparency and said opaque document.

10. A printing machine as recited in claim 2, further including:

means for developing each electrostatic latent image recorded on said photoconductive member with differently colored toner particles;

means for transferring the toner particles adhering to each of the electrostatic latent images to the sheet of support material in superimposed registration with one another; and means for fusing the toner particles to the sheet of support material.

11. A printing machine as recited in claim 2, wherein said notch filter has a transmittance of less than about 10% from a wavelength of about 580 nanometers to about 620 nanometers with the transmittance being greater than about 70% from a wavelength of about 380 nanometers to about 560 nanometes and from a wavelength of about 635 nanometers to about 700 nanometers.

12. A printing machine as recited in claim 11, wherein said filtering means includes:

a blue filter having a transmittance less than 10% from a wavelength of about 480 nanometers to about 630 nanometers with the transmittance being greater than 70% from a wavelength of about 375 nanometers to about 470 nanometers;

a red filter having a transmittance less than 10% from a wavelength of about 350 nanometers to about 560 nanometers with the transmittance being greater than 70% from a wavelength of about 580 nanometers to about 700 nanometers; and a green filter having a transmittance less than 10% from a wavelength of about 375 nanometers to about 470 nanometers and from a wavelength of about 570 nanometers to about 700 nanometers with the transmittance being greater than 70% from a wavelength of about 510 nanometers to about 550 nanometers.

* * * * *